US005602086A

United States Patent [19]

Le et al.

[11] Patent Number: 5,602,086

[45] Date of Patent: Feb. 11, 1997

[54] LUBRICANT COMPOSITIONS OF POLYALPHAOLEFIN AND ALKYLATED AROMATIC FLUIDS

[75] Inventors: Quang N. Le, Cherry Hill; Joosup Shim, Wenonah, both of N.J.

[73] Assignee: Mobil Oil Corporation, Fairfax, Va.

[21] Appl. No.: 634,135

[22] Filed: Apr. 19, 1996

Related U.S. Application Data

[63] Continuation of Ser. No. 495,241, Jun. 27, 1995, abandoned, which is a continuation of Ser. No. 376,538, Jan. 20, 1995, abandoned, which is a continuation of Ser. No. 915,392, Jul. 20, 1992, abandoned, which is a continuation of Ser. No. 639,861, Jan. 11, 1991, abandoned.

[51] Int. Cl.[6] ..... C10M 111/04

[52] U.S. Cl. ..... 508/591; 585/10; 585/25

[58] Field of Search ..... 585/10, 25; 508/591

[56] References Cited

U.S. PATENT DOCUMENTS

| | | | |
|---|---|---|---|
| 3,149,178 | 9/1964 | Hamilton et al. | 260/683.9 |
| 3,382,291 | 5/1968 | Brennan | 260/683.15 |
| 4,604,491 | 8/1986 | Dressler | 585/26 |
| 4,714,794 | 12/1987 | Yoshida | 585/26 |
| 4,777,307 | 10/1988 | Alward | 585/2 |
| 4,827,064 | 5/1989 | Wu | 585/10 |
| 4,967,029 | 10/1990 | Wu | 585/12 |
| 5,034,563 | 7/1991 | Ashijian et al. | 585/455 |
| 5,171,904 | 12/1992 | Sanderson et al. | 585/10 |
| 5,171,915 | 12/1992 | Forbus et al. | 585/455 |

*Primary Examiner*—Ellen M. McAvoy

*Attorney, Agent, or Firm*—Lori F. Cuomo; Dennis P. Santini

[57] ABSTRACT

The inclusion of alkylated aromatic base fluids, such as alkylated naphthalene, blending stocks with polyalphaolefin base fluids provides significant performance improvements in oxidation stability, solubility, elastomer compatibility and hydrolytic stability.

24 Claims, 1 Drawing Sheet

RBOT DATA ON PAO-5/AN-5 BLENDS

LUBRICANT COMPOSITIONS OF POLYALPHAOLEFIN AND ALKYLATED AROMATIC FLUIDS

This is a continuation of application Ser. No. 08/495,241, filed on Jun. 27, 1995, now abandoned, which is a continuation of application Ser. No. 08/376,538, filed on Jan. 20, 1995, now abandoned, which is a continuation of application Ser. No. 07/915,392, filed Jul. 20, 1992, now abandoned, which is a continuation of application Ser. No. 07/639,861, filed on Jan. 11, 1991, now abandoned.

BACKGROUND OF THE INVENTION

1. Field of the Invention

This application is directed to lubricant compositions and to a method of improving the stability of synthetic lube base stocks. This application is more particularly directed to alkylated aromatic base fluids as blending stocks with polyalphaolefin base fluids thereby providing synthetic lubricant compositions having significantly improved oxidation stability, solubility, elastomer compatibility and hydrolytic stability.

2. Description of Related Art

Synthetic hydrocarbon fluids useful as lubricant compositions are well know in the art. For example U.S. Pat. No. 3,149,178 (Hamilton et al.) discloses that thermally or catalytically polymerized alpha monoolefins provide lubricants having low pour points and high viscosity indices which nevertheless are not sufficiently stable to high temperature lubrication conditions and in some cases are insufficiently responsive to additives. Its solution to these problems is to remove the dimer portion of polymerized alpha monoolefins prior to hydrogenation and heat treat the product.

Further, various blends of one or more polyalphaolefins and esters plus additive packages have long been commercially available. Polyalphaolefin (PAO-based) lube products are often blended with carboxylic acid esters to improve the solvency of PAO base stocks, but, the addition of the esters causes reduced thermal/oxidation stability and hydrolytic stability of the PAO/ester blends. Also, alkylaromatic fluids have been proposed for use as certain types of functional fluids where good thermal and oxidative characteristics are required; see, for example, U.S. Pat. No. 4,714,794 (Yoshida et al.). The use of a mixture of monoalkylated and polyalkylated naphthalene as a base for synthetic functional fluids is also described in U.S. Pat. No. 4,604,491 (Dressler).

This invention provides PAO-based lube products of improved thermal/oxidation stability and hydrolytic stability comprising blends of PAO and alkylated aromatic base stocks.

To our knowledge, this thermal/oxidation stability improvement is unexpected and has not been demonstrated heretofore.

BRIEF SUMMARY OF THE INVENTION

This invention is directed to improved synthetic lubricant fluids comprising various blends of polyalphaolefins and alkylated aromatics and more particularly alkylated naphthalenes wherein the oxidation stability, additive solubility/stability and elastomer compatibility of PAO base stocks have been significantly improved by the inclusion of, for example, alkylated naphthalene (AN) base stocks as blending components.

The prime object of this invention therefore is to provide synthetic lubricant fluids, particularly PAO based fluids with improved thermal and oxidation stability and elastomer compatibility as well as additive solubility and stability.

Accordingly a lubricant composition is provided comprising a blend of (1) a high viscosity synthetic hydrocarbon prepared from high viscosity polyalphaolefin fluids or mixtures thereof and (2) alkylated aromatics, e.g., naphthalenes.

DESCRIPTION OF THE PREFERRED EMBODIMENTS

Figure 1:
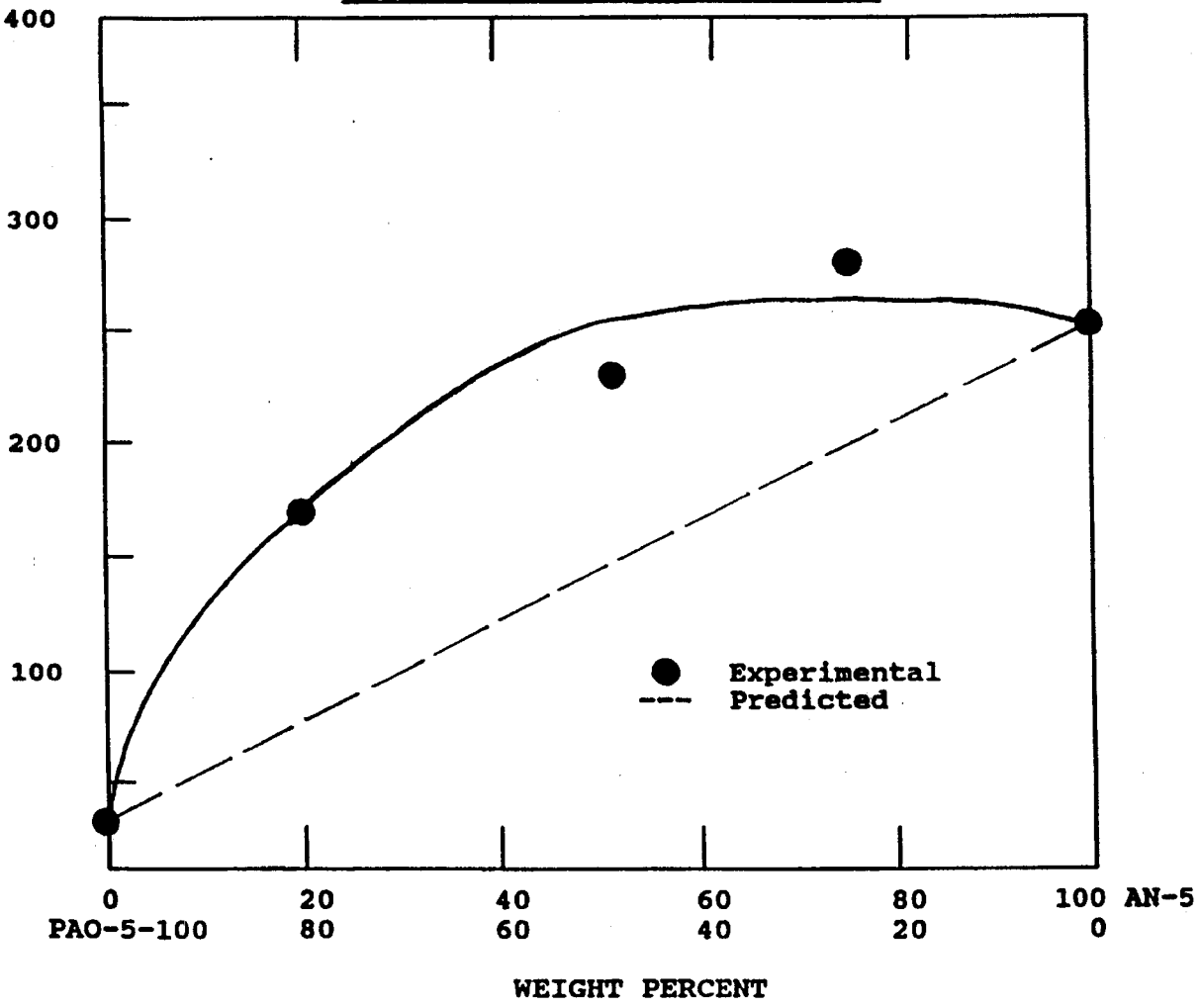
FIG. 1 is an RBOT stability curve of a PAO/AN blend.

Suitable aromatics include high molecular weight, e.g., 250 to about 3,000 MW alkylated benzenes, alkylated anthracenes, alkylated phenanthrenes, alkylated biphenyls and alkylated naphthalenes and the like. Preferred are alkylated naphthalenes.

According to the present invention the disclosed alkylated naphthalenes may be produced by any suitable means known in the art, from naphthalene itself or from substituted naphthalenes which may contain one or more short chain alkyl groups having up to about eight carbon atoms, such as methyl, ethyl or propyl, etc. Suitable alkyl-substituted naphthalenes include alpha-methylnaphthalene, dimethylnaphthalene and ethylnaphthalene. Naphthalene itself is preferred since the resulting mono-alkylated products have better thermal and oxidative stability than the more highly alkylated materials.

We prefer to use alkylnaphthalenes with an alpha:beta ratio of at least about 0.5 to 1 (molar), e.g., 0.8 for improved thermal and oxidative stability.

The production of alkylnaphthalenes with alpha:beta ratios of 1 and higher by the use of Fiedel-Crafts or acid catalysts is disclosed in Yoshida et al., U.S. Pat. No. 4,714,794. A preferred catalyst is zeolite MCM-22 which is described in U.S. Pat. No. 4,954,325 and which produces a highly linear alkylation product.

In general, the production of alkylnaphthalenes with alpha:beta ratios of 1 and higher is favored by the use of zeolite catalysts such as zeolite beta or zeolite Y preferably USY, of controlled acidity, preferably with an alpha value below about 200 and, for best results, below 100, e.g., about 25–50.

The alpha value of the zeolite is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis*, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980).

A convenient method of producing the embodied alkylated naphthalenes is disclosed in U.S. Pat. No. 5,034,563, entitled Naphthalene Alkylation Process and which is incorporated herein in its entirety by this reference thereto. Briefly in accordance with that method, long chain alkyl substituted naphthalenes are produced by the alkylation of naphthalene with an olefin such as an alpha-olefin or other alkylating agent such as an alcohol or alkyl halide possessing at least 6 carbon atoms, preferably 10 to 30 and most preferably 12 to 20 carbon atoms, in the presence of an alkylation catalyst comprising a zeolite which contains cations having a radius of at least 2.5A. Cations of this size may be provided by hydrated cations such as hydrated ammonium, sodium or potassium cations or by organoammonium cations such as tetraalkylammonium cations. The zeolite is usually a large pore size zeolite USY. The presence of the bulky cations in the zeolite increases the selectivity of the catalyst for the production of long chain mono-alkyl substituted naphthalenes in preference to more highly substituted products.

Suitable poly-alphaolefins may be derived from alphaolefins which include but are not limited to $C_2$ to about $C_{32}$ alphaolefins, preferred are $C_8$ to about $C_{16}$ alphaolefins, such as 1-decene, 1-dodecene and the like. Accordingly, a preferred polyalphaolefin is poly-1-decene or poly-1-dodecene.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate.

The polyalphaolefin lubricant fluids may be made by any method convenient to the art. For example the methods disclosed by Hamilton et al in U.S. Pat. No. 3,149,178 and Brennan in U.S. Pat. No. 3,382,291 may be conveniently used herein. Both of these patents (Hamilton et al and Brennan) are incorporated herein in their entirety by this reference. Other references which may provide useful means for producing the polyalphaolefin base stock include the following U.S. Pat. Nos.: 3,742,082 (Brennan); 3,769,363 (Brennan); 3,876,720 (Heilman); 4,239,930 (Allphin); 4,967,032 (Ho et al.); 4,926,004 (Pelrine et al.); 4,914,254 (Pelrine); 4,827,073 (Wu); and 4,827,064 (Wu). It is to be understood that the method of preparing the base stocks is not part of the invention. It is further understood that the PAO fluids may contain and usually do other substituents such as carboxylic acid esters and the like.

The average molecular weight of the PAO varies from about 250 to about 10,000 with a preferred range of from about 300 to about 3,000 with a viscosity varying from about 3 cS to about 300 cS at 100° C.

Concentrations of the alkylated aromatic preferably alkylated naphthalene (AN) in the PAO base stock can vary from about 1 wt % to less than about 50 wt % and preferably from about 5 to 45 wt % or 5 to about 25 wt % based on the total weight of the blend. The PAO fluids or blends in accordance with the invention may contain a carboxylic acid ester content up to but less than about 10 wt %. The preferred esters are the esters of monohydric alcohols, preferably having about 9 to 20 carbon atoms, and dibasic carboxylic acids, preferably having from about 6 to 12 carbon atoms, such as adipic or azelaic acids. Additives used for their known purposes, may comprise up to about 20% wt of these lubricant compositions and preferably from about 0.001 to about 10 wt % based on the total weight of the composition.

The additives contemplated for use herein can be, for example, rust and corrosion inhibitors, metal passivators, dispersants, antioxidants, thermal stabilizers, EP/antiwear agents and the like. These additives materials do not detract from the value of the compositions of this invention, rather they serve to impart their customary properties to the particular compositions in which they are incorporated.

In general, the lubricant blends of this invention may be of any suitable lubricating viscosity range, as for example, from about 3 to about 300 cS at 100° C. and preferably, from about 4 to about 250 cS at 100° C. The average molecular weights of these oils may range from about 200 to about 10,000 and preferably from about 250 to about 3,000.

These PAO/AN blends may be used in a variety of functional fluids such as cutting oils, transformer oils, brake fluids, transmission fluids, power steering fluids, steam or gas turbine circulating oils, compressor oils, various hydraulic fluids and the like as well as engine/crankcase oils and various greases.

Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which are normally employed for thickening or gelling hydrocarbon fluids for foaming grease can be used in preparing grease in accordance with the present invention.

Preferred thickeners for PAO greases are the organophillic clays described in U.S. Pat. No. 3,514,401 (Armstrong).

The following examples are merely illustrative and not meant to be limitations.

EXAMPLE I

PREPARATION OF AN-5

In this Example, an alkylated naphthalene fluid, having a viscosity around 4.8 cS at 100° C., was prepared from alkylating naphthalene with alpha C-16 olefin over a USY catalyst. The properties of this mono-alkylated naphthalene fluid, denoted as AN-5, are shown in Table 1.

EXAMPLE II

PREPARATION OF AN-13

The alkylated naphthalene prepared in this Example has a viscosity of about 13 cS at 100° C. It was manufactured from the reaction of naphthalene with alpha C-14 olefin using a homogenous acid catalyst solution (trifluoromethane sulfonic acid). The properties of the resultant poly-alkylated naphthalene, identified as AN-13, are shown in Table 1.

EXAMPLE III

PREPARATION OF PAO-5

Polyalphaolefin base stock, denoted as PAO-5, was prepared from the oligomerization of 1-decene using a procedure similar to that disclosed in U.S. Pat. No. 3,382,291 (Brennan). The properties of PAO-5 are shown in Table 1.

EXAMPLE IV

PREPARATION OF PAO-100

In this Example, a polyalphaolefin with a viscosity of about 100 cS at 100° C. was also synthesized from 1-decene in a manner similar to Example III. The properties of this very high viscosity polyalphaolefin, identified as PAO-100, are shown in Table 1.

EXAMPLE V

PREPARATION OF ESTER-5

In this Example, an adipate ester (or di-isotridecyl adipate) was prepared by reacting adipic acid with isodecyl alcohol. The resultant ester, identified as ESTER-5, has a viscosity of about 5.3 cS at 100° C. Its properties are shown in Table 1.

TABLE 1

INSPECTION PROPERTIES OF VARIOUS SYNTHETIC BASE FLUIDS

| BASE STOCK | EX. I (AN-5) | EX. II (AN-13) | EX. III (PAO-5) | EX. IV (PAO-100) | Ex. V (ESTER-5) |
|---|---|---|---|---|---|
| PROPERTIES | | | | | |
| Flash Point, °C. | 235 | 252 | 232 | 288 | 234 |
| Pour Point, °C. | –40 | –37 | –54 | –25 | <–54 |
| Viscosity, cS @ 40° C. | 28.6 | 114.1 | 31.0 | 1250 | 26.9 |
| @100 ° C. | 4.8 | 13.0 | 5.8 | 100 | 5.3 |
| Viscosity Index | 80 | 107 | 132 | 168 | 135 |

EVALUATION OF PRODUCT

Various PAO/AN blends were directly evaluated with uninhibited PAO base stock for oxidation stability. The results are recorded in Table 2. Oxidation stability data on uninhibited PAO/AN blends, presented in Table 2, show that the polyalphaolefin fluid PAO-5 (Ex. III) is readily oxidized, but that the alkylated aromatic fluid AN-5 (Ex. I) unexpectedly gives outstanding oxidation stability longer DSC and RBOT induction periods with lower B-10 viscosity and NN increases. Moreover, the oxidation stability of PAO-5 (Ex. III) improves markedly with increasing additions of AN-5 fluid. It is apparent from Table 2 that the alkylated naphthalene base stock is more stable than paraffinic PAO and that their blends have beneficial effects on stability. This is graphically depicted in the Figure wherein the effects of AN concentration on RBOT value is shown. NOTE:

(1) The RBOT test protocol is described in ASTM D2272.

(2) The B-10 oxidation test is used to evaluate mineral oil and synthetic lubricants either with or without additives. The evaluation is based on the resistance of the lubricant to oxidation by air under specified conditions as measured by the formation of sludge, the corrosion of a lead specimen, and changes in neutralization number and viscosity. In this method, the sample is placed in a glass oxidation cell together with iron, copper and aluminum catalysts and a weighed lead corrosion specimen. The cell and its contents are placed in a bath maintained at a specified temperature and a measured volume of dried air is bubbled through the sample for the duration of the test. The cell is removed from the bath and the catalyst assembly is removed from the cell. The oil is examined for the presence of sludge and the Neutralization Number (ASTM D664) and Kinematic Viscosity at 100° C. (ASTM D445) are determined. The lead specimen is cleaned and weighed to determine the loss in weight.

The oxidation stability was measured by differential scanning calorimetry (DSC) tests as described by R. L. Blaine in "Thermal Analytical Characterization of Oils and Lubricants", American Laboratory, Vol. 6, pp. 460–463 (January 1974) and F. Noel and G. E. Cranton in "Application of Thermal Analysis to Petroleum Research", American Laboratory, Vol. 11, pp. 27–50 (June 1979), the disclosures of which are incorporated herein by reference. The DSC cell was held isothermally at 180° C. An oxygen atmosphere maintained at about 500 psig was used. In this test procedure the induction time is measured until an exothermic release of heat marks the onset of the oxidation reaction.

The convex curve in FIG. 1 for RBOT data on PAO-5/AN-5 blends is unexpected. When two hydrocarbons of unequal stability are blended, an intermediate stability might be predicted, a straight line relation at best, or more likely a concave curve with the component of lower stability having oxidized preferentially. This surprising RBOT curve appears to signify a synergistic behavior of the PAO/AN blends. Table 2 summarizes these benefits for PAO-5/AN-5 blends. Similar benefits have been demonstrated by PAO-5/AN-13 blends which are summarized in Table 3.

Evaluation of inhibited PAO-5/AN-5 blends was repeated in the same tests to demonstrate antioxidant response. Results, summarized in Table 4, show that PAO-5, AN-13 and their blends have similar response to a hindered bisphenol (Ethyl 702) antioxidant activity.

Table 5 illustrates the additive solubility/stability of AN base stock for PAO/AN blends in the high-temperature storage stability test (14 days at 150° C.). UC ratings (a degree of cleanliness, 1=clean) improve with increasing concentration of AN-5 in the PAO/AN blends. The additive package A develops heavy sediments in PAO-5 as well as PAO-100.

Table 6 shows elastomer compatibility data on PAO/AN blends, indicating that the addition of AN base stocks in PAO base stocks would prevent elastomer shrinkage. This behavior with Buna-N has been clearly demonstrated by Examples 24 through 29.

Table 7 compares the hydrolytic stability of PAO/ester blend with that of PAO/AN blend, illustrating that potential hydrolysis problem could be eliminated by substituting esters with AN base stocks without having adversely affected the solvency of PAO/AN blends as shown in Tables 4 and 5.

TABLE 2

OXIDATION STABILITY OF EX. III (PAO-5)/EX. I (AN-5) BLENDS

| | EX. 1 | EX. 2 | EX. 3 | EX. 4 | EX. 5 |
|---|---|---|---|---|---|
| BLENDS | | | | | |
| PAO-5, wt % | 100 | 75 | 50 | 25 | — |
| AN-5, wt % | — | 25 | 50 | 75 | 100 |
| PERFORMANCE | | | | | |
| DSC-IP @180° C., Min | 2.5 | 11.5 | 22.0 | 60+ | 60+ |
| B-10 Oxidation (40 hr. @ 200° F.) | | | | | |
| Vis. Incr. | 92.4 | 29.0 | 11.1 | 3.2 | 4.6 |
| NN Incr. | 15.4 | 8.7 | 3.4 | 1.1 | 1.1 |
| RBOT, Min | 25 | 170 | 220 | 275 | 255 |

TABLE 3

OXIDATION STABILITY OF EX. III (PAO-5)/EX. II (AN-13) BLENDS

| | EX. 6 | EX. 7 | EX. 8 | EX. 9 | EX. 10 |
|---|---|---|---|---|---|
| BLENDS | | | | | |
| PAO-5, wt % | 100 | 75 | 50 | 25 | — |
| AN-13, wt % | — | 25 | 50 | 75 | 100 |

TABLE 3-continued

OXIDATION STABILITY OF EX. III (PAO-5)/EX. II (AN-13) BLENDS

| | EX. 6 | EX. 7 | EX. 8 | EX. 9 | EX. 10 |
|---|---|---|---|---|---|
| PERFORMANCE | | | | | |
| DSC-IP @ 180° C., Min | 2.5 | 14.5 | 25.3 | 60+ | 60+ |
| RBOT, Min | 23 | 130 | 185 | 220 | 205 |

TABLE 4

OXIDATION STABILITY OF INHIBITED EX. III (PAO-5)/EX. I (AN-5) BLENDS

| | EX. 11 | EX. 12 | EX. 13 | EX. 14 | EX. 15 |
|---|---|---|---|---|---|
| BLENDS | | | | | |
| PAO-5, wt % | 99.75 | 74.75 | 49.75 | 24.75 | — |
| AN-5, wt % | — | 25.00 | 50.00 | 75.00 | 99.75 |
| Antioxidant (Ethyl 702), wt % | 0.25 | 0.25 | 0.25 | 0.25 | 0.25 |
| PERFORMANCE | | | | | |
| DSC-IP @ 180°C., Min | 17.8 | 34.0 | 60+ | 60+ | 60+ |
| B-10 Oxidation (40 hr. @ 260° F.) | | | | | |
| Vis. Incr. % | 0.5 | 0.3 | 0.4 | 0.4 | 0.2 |
| NN Incr. | 0.05 | 0.1 | 0.1 | 0.1 | 0.05 |
| RBOT, Min | 160 | 215 | 255 | 320 | 365 |

TABLE 5

ADDITIVE SOLUBILITY/STABILITY

| | EX. 16 | EX. 17 | EX. 18 | EX. 19 | EX. 20 | EX. 21 | EX. 22 | EX. 23 |
|---|---|---|---|---|---|---|---|---|
| PAO-5, wt % | 97.62 | 87.62 | 72.62 | 47.62 | — | — | — | — |
| PAO-100, wt % | — | — | — | — | 97.62 | 87.62 | 72.62 | 47.62 |
| AN-5, wt % | — | 10.00 | 25.00 | 50.00 | — | 10.00 | 25.00 | 50.00 |
| Additive Package A, wt % | 2.38 | - - - | - - - | - - - | - - - | - - - | - - - | - - - |
| High-Temperature Storage Stability (14 @ 150°C.) | | | | | | | | |
| UC Rating (1 = Clean) | 5 | 3 | 1 | 1 | 4 | 3 | 1 | 1 |

TABLE 6

ELASTOMER COMPATIBILITY

| | EX. 24 | EX. 25 | EX. 26 | EX. 27 | EX. 28 | EX. 29 |
|---|---|---|---|---|---|---|
| BLENDS | | | | | | |
| PAO-5, wt % | 97.62 | 77.62 | — | — | 77.62 | |
| PAO-100, wt % | — | — | 97.62 | 77.62 | — | 77.62 |
| AN-5, wt % | — | 20.00 | — | 20.00 | — | — |
| AN-13, wt % | — | — | — | — | 20.00 | 20.00 |
| Additive Package A, wt % | 2.38 | - - - | - - - | - - - | - - - | - - - |

TABLE 6-continued

| ELASTOMER COMPATIBILITY | EX. 24 | EX. 25 | EX. 26 | EX. 27 | EX. 28 | EX. 29 |
|---|---|---|---|---|---|---|
| PERFORMANCE<br>Rubber Swell (336 hr @ 93°C.)<br>% Vol. change | | | | | | |
| Buna-N | −4.17<br>−3.84 | +6.97<br>+7.40 | −3.27<br>−3.84 | +2.14<br>+1.95 | +4.65<br>+4.85 | +5.54<br>+6.16 |

TABLE 7

| HYDROLYTIC STABILITY | EX. 30 | EX. 31 |
|---|---|---|
| BLENDS | | |
| PAO-5, wt % | 72.62 | 72.62 |
| ESTER-5, wt % | 25.00 | — |
| AN-5, wt % | — | 25.00 |
| Additive Package A, wt % | 2.38 | 2.38 |
| PERFORMANCE<br>Hydrolytic Stability<br>(ADTM D-2619) | | |
| Copper Corrosion, mg/cm$^2$ | 0.15 | 0.0 |
| Viscosity Change, % | 0.7 | 0.6 |
| gTAN/change, mg KOH/g | 0.22 | 0.03 |
| Total Acidity of Water mg KOH | 19.9 | 4.9 |

The hereinabove referred to Additive Package A comprises a standard state of the art antioxidant, antiwear, rust-inhibiting, metal-passivating additive package.

As demonstrated in the various Tables shown above, the PAO-AN blends in accordance with this invention provide improved oxidation stability by control of, for example, the viscosity increase and neutralization number and by increasing induction periods (see Tables 2, 3 and 4); provides additive stability/solubility (see Table 5); provides elastomer compatibility by controlling rubber swell (see Table 6); and provides hydrolytic stability by controlling acidity (see Table 7).

What is claimed is:

1. In a polyalphaolefin-based lubricant composition comprising a mixture of synthetic fluids of lubricating viscosity comprising (1) a polyalphaolefin lubricant fluid, (2) a lubricant fluid to confer solvency and elastomer compatibility, and (3) an additive package comprising corrosion inhibitors, metal passivators, dispersants, and antioxidants, the improvement comprising the use of an alkylated naphthalene as the lubricant fluid to confer solvency and elastomer compatibilty, the polyalphaolefin fluid comprising from about 95 to about 99 wt % based on the total weight of the composition, and the alkylated naphthalene from about 1 to about 5 wt % based on the total weight of the composition, the composition having improved oxidation stability and thermal solubility, elastomer compatibility and hydrolytic stability.

2. The composition of claim 1 wherein the mixture contains from about 0.001 to about 10 wt % of the additive package.

3. The composition of claim 1 wherein the polyalphaolefin fluid has a viscosity from about 3 cS to about 300 cS at 100° C.

4. The composition of claim 3 wherein said PAO fluid is derived from $C_8$ to $C_{16}$ alphaolefins by oligomerization with a Friedel Crafts catalyst.

5. The composition of claim 4 wherein said polyalphaolefin fluid is derived from 1-decene.

6. The composition of claim 1 wherein the alkylated naphthalene is derived from a $C_6$ to a $C_{30}$ alkylating agent.

7. The composition of claim 6 wherein said alkylated naphthalene is derived from $C_{14}$ and $C_{16}$ alphaolefins.

8. The composition of claim 7 wherein the alkylated naphthalene is derived from a 1-tetradecene alkylating agent.

9. The composition of claim 7 wherein the alkylated naphthalene is dervied from a 1-hexadecene alkylating agent.

10. The composition of claim 1 wherein the alkylated naphthalene has a viscosity varying from about 4 cS to about 30 cS at 100° C.

11. The composition of claim 1 wherein the mixture contains from about 0.001 to about 20 wt % of the additive package.

12. The composition of claim 1, wherein the mixture further comprises carboxylic acid ester in an amount up to but less than about 10 wt %.

13. In a polyalphaolefin-based lubricant composition comprising a mixture of synthetic fluids of lubricating viscosity comprising (1) a polyalphaolefin lubricant fluid, (2) a lubricant fluid to confer solvency and elastomer compatibility, and (3) an additive package comprising corrosion inhibitors, metal passivators, dispersants, and antioxidants, the improvement comprising the use of alkylated naphthalene as the lubricant fluid to confer solvency and elastomer compatibility, the polyalphaolefin fluid comprising from about 80 to about 99 wt % based on the total weight of the composition, and the alkylated naphthalene from about 1 to about 20 wt % based on the total weight of the composition, the composition having improved oxidation stability and thermal solubility, elastomer compatibility and hydrolytic stability.

14. The composition of claim 13 wherein the mixture contains from about 0.001 to about 10 wt % of the additive package.

15. The composition of claim 13 wherein the polyalphaolefin fluid has a viscosity from about 3 cS to about 300 cS at 100° C.

16. The composition of claim 15 wherein said PAO fluid is derived from $C_8$ to $C_{16}$ alphaolefins by oligomerization with a Friedel Crafts catalyst.

17. The composition of claim 16 wherein said polyalphaolefin fluid is derived from 1-decene.

18. The composition of claim 13 wherein the alkylated naphthalene is derived from a $C_6$ to $C_{30}$ alphaolefins.

19. The composition of claim 18 wherein said alkylated naphthalene is derived from a $C_{14}$ to $C_{16}$ alphaolefins.

20. The composition of claim 19 where the alkylated naphthalene is derived from a 1-tetradecene alkylating agent.

21. The composition of claim 19 where the alkylated naphthalene is derived from a 1-hexadecene alkylating agent.

22. The composition of claim 13 wherein the alkylated naphthalene has a viscosity varying from about 4 cS to about 30 cS at 100° C.

23. The composition of claim 13 wherein the mixture contains from about 0.001 to about 20 wt % of the additive package.

24. The composition of claim 13, wherein the mixture further comprises carboxylic acid ester in an amount up to but less than about 10 wt %.

* * * * *